United States Patent [19]

Ostrowski

[11] 4,180,918

[45] Jan. 1, 1980

[54] MICROWAVE DRYING OF CERAMIC SHELL MOLDS

[75] Inventor: Richard C. Ostrowski, Dunlap, Ill.

[73] Assignee: Caterpillar Tractor Co., Peoria, Ill.

[21] Appl. No.: 949,324

[22] Filed: Oct. 6, 1978

[51] Int. Cl.[2] ..... F26B 7/00; F26B 2/28

[52] U.S. Cl. ..... 34/13; 34/4; 34/15; 34/92

[58] Field of Search ..... 34/4, 12, 15, 92, 1, 34/13; 264/25; 249/78; 425/174, 174.4

[56] References Cited

U.S. PATENT DOCUMENTS

| | | | |
|---|---|---|---|
| 3,191,250 | 6/1965 | Mellen, Jr. et al. | 164/154 |
| 3,704,523 | 12/1972 | Guerga et al. | 34/1 |
| 3,732,048 | 5/1973 | Guerga et al. | 425/174.4 |
| 3,850,224 | 11/1974 | Vidmar et al. | 164/4 |
| 4,043,380 | 8/1977 | Valentine | 164/41 |

*Primary Examiner*—John J. Camby

*Attorney, Agent, or Firm*—Wegner, Stellman, McCord, Wiles & Wood

[57] ABSTRACT

A method of drying a refractory slurry layer deposited on a mold pattern (10) formed of a thermally fusible material having low heatability by subjection to microwave energy (E), to form a shell mold. The mold pattern (10) is coated with a slurry layer and is subjected to microwave energy (E) sufficient to heat the refractory slurry. A portion of the liquid phase of the heated slurry is withdrawn while concurrently cooling the slurry and mold pattern to maintain the mold pattern at a temperature subjacent the fusion temperature of the mold pattern material. The mold pattern (10) may be recoated, resubjected concurrently to microwave energy (E) and withdrawal of the liquid phase of the slurry until the slurry is effectively dried in the mold pattern while effectively preventing undesirable thermal distortion of the mold pattern.

15 Claims, 1 Drawing Figure

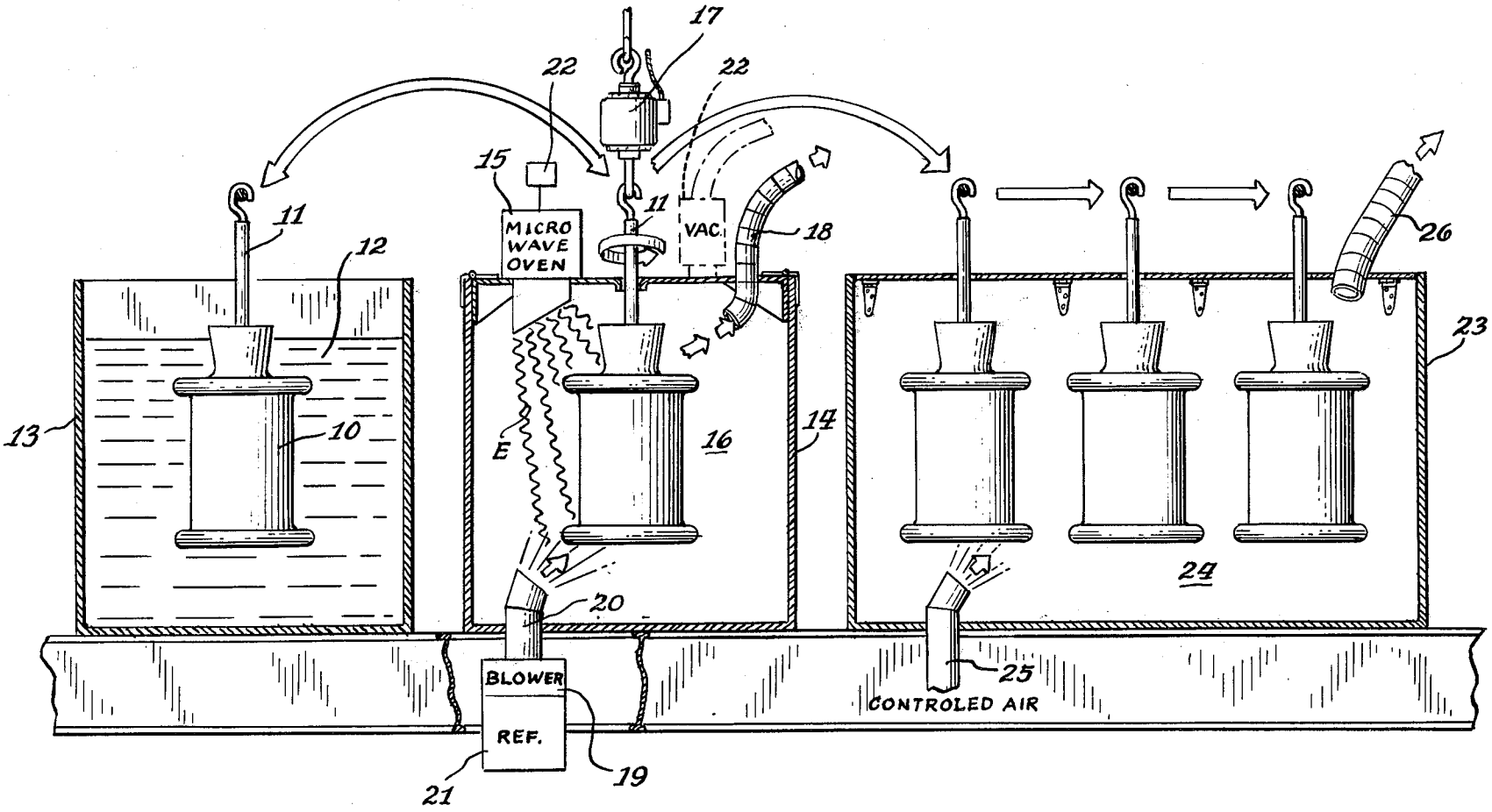
23
26
24
25
CONTROLED AIR
14
18
16
17
22
VAC.
11
MICRO WAVE OVEN
15
E
20
19
BLOWER
REF.
21
12
10
13

MICROWAVE DRYING OF CERAMIC SHELL MOLDS

TECHNICAL FIELD

This invention relates to the forming of shell molds on expendable patterns such as for use in manufacturing castings by the lost wax casting process.

BACKGROUND ART

In one method of forming refractory shell molds, layers of refractory slurry material are successively deposited on a pattern to build up the mold to the desired thickness whereupon the pattern, which is preferably formed of an expendable material, such as wax, is removed from the interior of the formed shell to define the casting mold.

A problem arises in such manufacture of shell molds in that it is desirable to dry each successively applied slurry layer before applying the successive layer. To avoid the need for such drying, one improved method of forming such molds has utilized a system of providing two different binders in successive layers which cooperate with each other to provide substantially instantaneous gelling of the layers so that the successive layers may be quickly applied without waiting for the drying of the preceding layer. However, this method has the serious problem of requiring that the entire layered mold be subsequently dried before use as a casting mold and it has been found that such drying operation requires a substantial amount of time which, in many cases, is greater than the total amount of drying time required where each of the layers is dried before application of the successive layer.

In the conventional systems effecting a drying of the individual layers during the formation of the mold, such drying must be effected by a desiccant system. Such desiccant drying systems require regeneration operations for economical utilization and present the serious disadvantage of requiring a relatively large area and relatively expensive equipment.

Another technique in effecting the drying of the successive layers has been to utilize humidity-controlled air flow systems. Such systems have been found to be reasonably satisfactory on small molds, but have not proven fully satisfactory where the molds are of relatively large size, such as for use in forming castings utilized in tractors and the like.

A problem arises in attempting to expedite the drying of the water-based slurries conventionally used in such mold formation in that the use of heat to effect such expediting of the drying is preferably avoided so as to avoid deformation of the wax patterns. It has been found that the wax patterns tend to expand when heated and, thus, tend to crack the ceramic layers. Where unheated air is utilized to effect the drying operation, it has been found that undesirable long periods of drying time are necessary, such as two to three hours for each coat.

One improved high speed drying apparatus for refractory shell molds is shown in U.S. Pat. No. 3,191,250 of Edward J. Mellen, Jr. et al, issued June 29, 1965. The apparatus disclosed therein utilizes blower means for forcing air through suitable tunnels in which the coated patterns are passed with the respective slurry layers being dusted with dry ceramic particles and wherein the humidity of the air is regulated to maintain a desired wet bulb temperature therein.

In U.S. Pat. No. 3,704,523, Michel Henri Guerga et al teach the use of microwave heating and air ventilation means for drying molded ceramic objects. The method utilizes an application of microwave energy in a first oven while applying a relatively light flow of air against the objects. The objects are then maintained at a constant temperature in a second microwave oven while applying a heavy flow of air to evaporate the water. The objects are cast in molds formed of a material which does not absorb water so that the molds are not appreciably heated by the microwave energy. Both the mold and article are heated to the predetermined temperature so as to dry the article which is contained in the mold.

An apparatus for casting of ceramics is shown in U.S. Pat. No. 3,732,048, issued May 8, 1973, of Michel Henri Guerga et al, wherein a mold is filled with a slurry. Microwave energy is applied to heat the mold and slurry to a first predetermined temperature and at a later time to reheat and harden the ceramic material in the mold. Means are provided for directing a flow of air within the mold simultaneously with the application of radiation during the subsequent heating operation.

In U.S. Pat. No. 3,850,224, issued Nov. 26, 1974, Albert Vidmar et al disclose a process and apparatus for drying shell molds utilizing circulated and conditioned air so as to provide a rapid flow thereof over patterns for forming shell molds thereon. Each coat of the built-up shell is dried before the next coat is applied, the drying being effected by directing a large number of air jets laterally against the coated pattern at a velocity of at least 1000 feet per minute in an impact drying zone while controlling the temperature and humidity of the air supplied to the jets to maintain predetermined wet bulb and dry bulb temperatures wherein the wet bulb temperature is maintained about equal to the pattern temperature and at least 10 degrees below the dry bulb temperature.

James M. Valentine discloses a production of plaster molds by microwave treatment in U.S. Pat. No. 4,043,380 issued Aug. 23, 1977, wherein metal casting components are produced from a compacted mass of plaster by two-stage drying treatment in a microwave oven with an intermediate cooling step. The mass of moldable suspension of plaster and water is molded into a predetermined configuration and the molded mass is then subjected to electromagnetic energy at microwave frequency. In the process, the component is heated to a temperature of approximately 300° F. with the intermediate cooling step permitting the object to be reduced in temperature to approximately 200° F.

DISCLOSURE OF INVENTION

In one aspect, the present invention comprehends an improved method of drying a refractory slurry layer deposited on a mold formed of a thermally fusible material having low heatability by subjection to microwave energy.

More specifically, the method of drying the slurry layer of the present invention comprehends subjecting the mold pattern with the slurry layer thereon to microwave energy sufficient to heat the refractory slurry, withdrawing a portion of the liquid phase of the heated slurry while concurrently cooling the slurry and mold pattern to maintain the mold pattern at a temperature subjacent the fusion temperature of the mold pattern material, and repeating these steps until the slurry is effectively dried in the mold pattern while effectively preventing undesirable thermal distortion of the mold pattern.

A portion of the liquid phase of the slurry may be withdrawn concurrently with subjecting the mold pattern and slurry layer thereon to the microwave energy.

In the illustrated embodiment, the mold pattern is formed of wax. The subjecting of the mold and slurry layer thereon to microwave energy may be carried out concurrently with the step of withdrawing a portion of the liquid phase.

The withdrawing of the portion of the liquid phase may be continuously effected while the application of the microwave energy may be intermittently effected.

The cooling of the mold pattern and slurry thereon may be continuously effected.

The withdrawing of the liquid phase may be effected by passing cool dry air in drying relationship to the slurry. Alternatively, the withdrawing of the liquid phase may be effected by applying a vacuum to the environment of the mold.

The invention further comprehends the providing of a plurality of such slurry layers, each of which is effectively dried by the disclosed method before applying the subsequent layer material.

As the drying of each slurry layer may be rapidly and efficiently effected, a rapid buildup of the refractory material to form the shell mold is efficiently effected by means of the method of the present invention. The intermittent subjection of the slurry coated mold pattern to microwave energy permits the effective removal of the liquid phase while concurrently maintaining the temperature of the thermally degradable mold so as to effectively prevent distortion thereof as by thermal fusion notwithstanding the application of heat energy to the slurry in the drying process.

BRIEF DESCRIPTION OF THE DRAWING

Other features and advantages of the invention will be apparent from the following description of an embodiment of the present invention taken in connection with the accompanying drawing which comprises a schematic vertical section of an apparatus for forming a shell mold by the method of the invention.

BEST MODE FOR CARRYING OUT THE INVENTION

In the illustrated embodiment of the invention as shown in the drawing, an improved method of drying a refractory slurry layer deposited on a mold pattern formed of a thermally fusible material having low heatability by subjection to microwave energy is shown to include the steps of depositing a slurry layer on the mold pattern, heating the slurry on the mold pattern by means of microwave energy, and either concurrently or subsequently withdrawing the portion of the liquid phase of the heated slurry while effectively cooling the slurry and mold pattern to maintain the temperature of the mold pattern below the fusion temperature of the mold pattern material. The partially dried slurry layer may then be reheated by resubjection to microwave energy and the liquid phase withdrawing and cooling steps repeated to further dry the slurry layer. The steps of heating the slurry layer by microwave energy and withdrawing the liquid phase while concurrently cooling the slurry layer may be repeated until the layer is effectively dried. Thereupon, a subsequent wet slurry layer may be applied over the thusly effectively dried slurry layer and the process repeated so as to permit building up a plurality of dried layers quickly and efficiently in the practice of the method.

The invention comprehends that the withdrawal of the liquid phase of the slurry may be effected by subjecting the slurry layer to a flow of dry air thereagainst. Alternatively, the liquid phase may be withdrawn by subjecting the environment of the coated mold pattern to a vacuum.

The heating of the coated mold pattern may be effected intermittently so that the cooling effect may be produced between the heating operations, thereby maintaining the thermally fusible mold pattern material below the fusion temperature and thereby effectively preventing distortion of the mold pattern as a result of the heating of the slurry layer to facilitate the rapid drying thereof.

The invention comprehends that the subjection of the slurry layer to the drying air or vacuum may be effected continuously so as to permit the intermittent microwave heating of the slurry layer to be extended and thus provide further improved rapid drying of the shell mold layers. A final stage of drying by subjecting the slurry to a drying air flow may be effected as desired.

In the illustrated embodiment, the mold pattern is formed of wax and the cooling of the coated mold pattern is effected suitably to maintain the temperature of the mold pattern below approximately 85° F. so as to effectively avoid thermal distortion of the mold pattern.

If desired, the drying air may be refrigerated prior to the directing thereof against the slurry layer to effect the desired withdrawal of the heated liquid phase thereof.

Thus, the invention comprehends an improved method of drying the refractory slurry layers to form the desired shell mold by means of a temperature and humidity-controlled environment in conjunction with an intermittent application of microwave energy to the slurry coated mold patterns.

INDUSTRIAL APPLICABILITY

In the illustrated embodiment of the invention as shown in the drawing, a mold pattern generally designated 10 is shown to be supported by a suitable conveyor hook 11 so as to be firstly immersed in a bath of refractory slurry material 12 suitable to form the desired shell mold. The slurry material may be maintained in a suitable tank 13.

Upon the coating of the mold pattern 10 with the slurry material, the coated mold pattern may be brought by a suitable conveyor into a microwave oven cabinet generally designated 14. A conventional microwave generator 15 is associated with the cabinet 14 for generating microwave energy E within the chamber 16 of the cabinet 14 in which the coated mold pattern is retained. As illustrated in the drawing, during the heating of the coated mold pattern by the microwave energy, the mold pattern may be rotated on the carrier 11 by a suitable electric motor drive 17 utilized to support the carrier 11 during this heating operation. Thus, an improved uniform application of the microwave energy to the slurry layer is effected.

As further shown in the drawing, drying air may be directed through chamber 16 so as to withdraw at least a portion of the liquid phase of the heated slurry to effect the desired drying of the slurry layer. The air may be flowed in drying relationship with the slurry layer on a mold pattern and discharged from chamber 16 from a discharge duct 18. The drying air may be provided to the chamber by a suitable air moving means, such as blower 19, so as to enter the chamber through a suitable inlet duct 20.

If desired, the drying air may be refrigerated prior to its delivery into chamber 16 as by a conventional air cooling refrigeration means 21.

As indicated above, the withdrawal of the liquid phase portion of the heated slurry may be alternatively effected by the application of a vacuum to the chamber 16 and for this purpose, a conventional vacuum pump 22 may be provided for withdrawing air from the chamber 16, as shown in the drawing in broken lines.

The application of the microwave energy E to the slurry coating may cause some heating of the mold pattern. Such heating may be effected by conduction from the heated slurry layer and, to some limited extent, by the action of the microwave energy on the mold pattern material, although such mold material may have a relatively low heatability by such microwave energy. The invention, however, comprehends that the cooling of the slurry layer be effected so as to maintain the temperature of the mold pattern below the fusion temperature thereof, and as indicated above, where the mold pattern is formed of wax, below 85° F.

Thus, the invention comprehends the intermittent energization of the microwave generator 15 as by a suitable control 22 so as to permit the drying operation to concurrently effect a sufficient cooling of the slurry layer and subjacent mold pattern to prevent the undesirable fusion of the subjacent mold pattern material.

It has been found that by utilizing such an intermittent heating operating concurrently or sequentially with a cooling operation, a substantial increase in the rate of drying of the slurry layer may be effected while effectively preventing undesirable thermal distortion of the mold pattern material.

Upon completion of the drying of the slurry layer, the coated mold pattern may be returned to the bath 12 for application of a second such layer and the thusly recoated mold pattern returned to the oven for similar drying of the second coating. This operation may be repeated until a sufficient number of dried layers are sequentially formed to produce the desired shell mold.

As further indicated in the drawing, the mold patterns with the built-up shell mold layers thereon may be transferred to a final drier 23 defining a drying chamber 24 through which drying air may be flowed as from a suitable inlet supply 25 and withdrawn through a suitable discharge duct 26. The shell molds may be retained on the mold patterns in chamber 24 until a final and complete drying of the entire shell mold structure is effected.

In one illustrative apparatus for practicing the improved method of the present invention, a microwave generator of approximately 6 kW rating providing a power density of approximately 200 watts per cubic foot within the microwave chamber 16 was utilized by providing a 10-second energization with a one-minute drying and cooling step. An effectively complete drying of each layer was effected thusly within a total time of five minutes per layer without thermal degradation of the wax mold pattern. The drying and cooling air was provided at a temperature of approximately 55° F. and at approximately 50% relative humidity. Experiments have shown that a range of microwave heating time may be utilized, and as will be obvious to those skilled in the art, such heating time may be varied as a function of the power density provided by the generator 15. Thus, while variations in the drying air flow and temperature and power densities may be utilized, it is desirable in the practice of the invention to maintain the parameters suitably to prevent thermal distortion of the mold pattern and, thus, where the mold pattern is formed of wax, a temperature of the mold pattern above 85° F.

As discussed above, the cooling and drying steps may be effected as desired concurrently or sequentially relative to the microwave energy heating steps within the scope of the invention.

The foregoing disclosure of specific embodiments is illustrative of the broad inventive concepts comprehended by the invention.

What is claimed is:

1. A method of drying a refractory slurry layer deposited on a mold pattern (10) formed of a thermally fusible material having low heatability by subjection to microwave energy (E), to form a shell mold, comprising the steps of:

(a) subjecting the mold pattern (10) with the slurry layer thereon to microwave energy (E) sufficient to heat the refractory slurry;

(b) withdrawing a portion of the liquid phase of the heated slurry while concurrently cooling the slurry and mold pattern to maintain the mold pattern at a temperature subjacent the fusion temperature of the mold pattern material; and (c) repeating steps (a) and (b) until the slurry is effectively dried in the mold pattern while effectively preventing undesirable thermal distortion of the mold pattern.

2. The method of drying a slurry layer of claim 1 wherein a portion of the liquid phase is withdrawn concurrently with the subjecting of the mold pattern with the slurry layer thereon to the microwave energy.

3. The method of drying a slurry layer of claim 1 wherein the mold pattern is formed of wax.

4. The method of drying a slurry layer of claim 1 wherein step (b) is effected concurrently with effecting step (a).

5. The method of drying a slurry layer of claim 1 wherein step (b) is continuously effected and step (a) is discontinuously effected whereby the temperature of the slurry is caused to increase and decrease sequentially.

6. The method of drying a slurry layer of claim 1 wherein the mold pattern is formed of wax and said temperature to which the wax is heated is no greater than approximately 85° F.

7. The method of drying a slurry layer of claim 1 wherein step (b) comprises a step of applying a vacuum to the environment of the mold pattern.

8. A method of drying a refractory slurry layer deposited on a mold pattern (10) formed of a thermally fusible material having low heatability by subjection to microwave energy (E), to form a shell mold, comprising the steps of:

(a) subjecting the mold pattern (10) with the slurry layer thereon to microwave energy (E) sufficient to heat the refractory slurry;

(b) provide cool drying air in heat and moisture transfer relationship to the slurry layer on the mold pattern for withdrawing a portion of the liquid phase of the heated slurry while concurrently cooling the slurry and mold pattern to maintain the mold pattern at a temperature subjacent the fusion temperature of the mold pattern material; and (c) repeating steps (a) and (b) until the slurry is effectively dried in the mold pattern while effectively preventing undesirable thermal distortion of the mold pattern.

9. The method of drying a slurry layer of claim 8 wherein said steps (a) and (b) are carried out sequentially.

10. The method of drying a slurry layer of claim 8 wherein said steps (a) and (b) are carried out concurrently.

11. The method of drying a slurry layer of claim 8 wherein the cool air is flowed against the slurry layer in step (b).

12. A method of drying a refractory slurry layer deposited on a mold pattern (10) formed of a thermally fusible material having low heatability by subjection to microwave energy (E), to form a shell mold, comprising the steps of:

(a) subjecting the mold pattern with the slurry layer thereon to microwave energy sufficient to heat the refractory slurry;

(b) subjecting the mold pattern with the slurry layer thereon to a vacuum for withdrawing a portion of the liquid phase of the heated slurry while concurrently cooling the slurry and mold pattern to maintain the mold pattern at a temperature subjacent the fusion temperature of the mold pattern material; and (c) repeating steps (a) and (b) until the slurry is effectively dried in the mold pattern while effectively preventing undesirable thermal distortion of the mold pattern.

13. The method of drying a slurry layer of claim 12 wherein said mold pattern with the slurry layer thereon is disposed within a vacuum chamber and said steps (a) and (b) are carried out with the mold pattern with said slurry layer retained therein.

14. The method of drying a slurry layer of claims 1, 8, or 12 wherein a second slurry layer is applied to the dried layer and steps (a) and (b) are repeated.

15. The method of drying a slurry layer of claims 1, 8, or 12 wherein a plurality of additional slurry layers are applied sequentially with each applied layer being dried by conducting steps (a) and (b) before applying the next subsequent slurry layer.

* * * * *